US007570902B2

(12) United States Patent
Takamatsu

(10) Patent No.: US 7,570,902 B2
(45) Date of Patent: Aug. 4, 2009

(54) CHARGING DEVICE, PHOTOCONDUCTIVE DRUM UNIT, AND IMAGE FORMING DEVICE

(75) Inventor: Naritoshi Takamatsu, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 207 days.

(21) Appl. No.: 11/681,904

(22) Filed: Mar. 5, 2007

(65) Prior Publication Data

US 2007/0223961 A1 Sep. 27, 2007

(30) Foreign Application Priority Data

Mar. 23, 2006 (JP) ..... 2006-080854

(51) Int. Cl.
*G03G 15/00* (2006.01)

(52) U.S. Cl. ..... 399/170

(58) Field of Classification Search ..... 399/171–172; 250/324–326; 361/225, 229
See application file for complete search history.

(56) References Cited

U.S. PATENT DOCUMENTS

| | | | | |
|---|---|---|---|---|
| 3,908,127 A | | 9/1975 | Clark | |
| 4,550,253 A | * | 10/1985 | Hashimoto | 250/326 |
| 5,216,465 A | * | 6/1993 | Arai et al. | 399/90 |
| 5,701,559 A | * | 12/1997 | Ootaka et al. | 399/149 |
| 5,844,768 A | * | 12/1998 | Yamanaka | 361/229 |
| 5,909,608 A | | 6/1999 | Manno et al. | |

FOREIGN PATENT DOCUMENTS

| | | | |
|---|---|---|---|
| JP | 03-81950 U | | 8/1991 |
| JP | 03223773 A | * | 10/1991 |
| JP | 04-018572 A | | 1/1992 |
| JP | 04-133258 U | | 12/1992 |
| JP | 06-035296 A | | 2/1994 |

OTHER PUBLICATIONS

Official communication issued in the counterpart European Application No. 07103027.4, mailed on Jul. 18, 2007.

* cited by examiner

*Primary Examiner*—David M Gray
*Assistant Examiner*—Barnabas T Fekete
(74) *Attorney, Agent, or Firm*—Keating & Bennett, LLP

(57) ABSTRACT

A photoconductive drum unit includes a frame, a photoconductive drum, and a scorotron charging unit. The charging unit includes a pair of mounting members, a discharging electrode filament, a shield casing, a grid, and a connecting member. The mounting members are mounted and fixed at both end portions of the frame. The discharging electrode filament extends between the mounting members in a tensioned state. The shield casing is supported by being connected between the mounting members and covers the discharging electrode filament. The grid extends between the mounting members in a tensioned state and is arranged in an opening of the shield casing. The connecting member connects the mounting members and the shield casing in a state in which a slight displacement is permitted between the mounting members and the shield casing.

21 Claims, 3 Drawing Sheets

CHARGING DEVICE, PHOTOCONDUCTIVE DRUM UNIT, AND IMAGE FORMING DEVICE

BACKGROUND OF THE INVENTION

1. Field of the Invention

The present invention relates to a photoconductive drum unit which defines an electrophotographic image forming device. The image forming device is used in a facsimile machine, a copier, or a printer or the like (including a Multi Function Peripheral (MFP) of the facsimile machine, the copier, and/or the printer). More specifically, the present invention relates to a photoconductive drum unit including a scorotron charging unit.

2. Description of the Related Art

In the electrophotographic image forming device, a photoconductive drum is rotatably supported on a unit frame. A scorotron charging unit is mounted and fixed on the unit frame such that the scorotron charging unit is arranged to face a surface of the photoconductive drum and along a longitudinal direction of the photoconductive drum. The unitized photoconductive drum unit is widely used. In such a scorotron charging method, when a distance between the surface of the photoconductive drum and a grid is not maintained at an equal distance at all positions in the longitudinal direction of the photoconductive drum, an uneven charge is generated in the longitudinal direction of the photoconductive drum which influences the image quality.

In a conventional charging unit, a shield casing, a discharge wire (filament), and a grid are integrally assembled as one unit. The charging unit is fixed on a unit frame by tightening screws at both ends of the unit frame in its longitudinal direction. Further, the unit frame supports a photoconductive drum. Since the unit frame is made of resin or plastic, the unit frame may be twisted or distorted in its longitudinal direction. Additionally, since the charging unit is formed as a solid singular body, when the charging unit is fixed onto the unit frame by tightening the screws, it is difficult for the charging unit to respond to the distortion of the unit frame. Thus, there has been a problem that a distance between the grid and the surface of the photoconductive drum is not constant in the longitudinal direction.

According to one conventional device, a scorotron charging unit includes a holding member that holds a grid plate on a shaft of a photoconductor. In such a charging unit, there has been a problem that a distance between the surface of the photoconductor and the grid plate changes according to a degree of eccentricity of the shaft. Therefore, according to a conventionally known scorotron charging unit, a positioning member is provided for maintaining a prescribed distance between the surface of the photoconductor and the grid plate by making contact with the surface of the photoconductor. The positioning member applies tension to the grid plate in its longitudinal direction. According to another conventional device, a grid electrode is provided separately from a main body of a charging device. The grid electrode is supported via a positioning member and a position adjusting device with respect to a photoconductor supporting body (unit frame), which rotatably supports a photoconductive drum.

In a conventional scorotron charging unit, the charging unit is supported between holders that are fixedly mounted on the unit frame. Accordingly, since the holding members of the grid plate are positioned by the positioning member making contact with the surface of the photoconductor, a prescribed interval can be maintained between the grid plate and the photoconductor. However, since the positioning member is required to be coated with a low-friction material such as TEFLON (registered trademark), an increase in cost is inevitable. Moreover, since the holders fixedly mounted on the unit frame are integrally formed with the charging unit, the charging unit and the unit frame are formed as one solid body. Therefore, even when the unit frame is distorted, it is difficult for the charging unit to respond to such distortion. As a result, it is also difficult to reliably mount and fix the charging unit in such a situation.

According to a second known charging device, a grid electrode is provided separately from a charging device main body, and is mounted on a unit frame of a photoconductive drum. According to this structure, since a positioning member and a position adjusting device are required, the number of components increases causing an increase in cost. Furthermore, since the grid electrode is mounted on the unit frame, when the charging device and the photoconductive drum are formed as a drum unit, it becomes necessary to adjust the position of the charging device main body and the grid electrode.

SUMMARY OF THE INVENTION

In order to overcome the problems described above, preferred embodiments of the present invention provide a charging unit that has a simple structure and that responds to distortion or the like of a unit frame to enable a prescribed positional relationship to be maintained between the charging unit and a photoconductive drum.

According to a preferred embodiment of the present invention, a photoconductive drum unit includes a unit frame, a photoconductive drum, and a scorotron charging unit. The photoconductive drum is supported rotatably on the unit frame. The scorotron charging unit is arranged facing a surface of the photoconductive drum, and fixedly mounted on both end portions of the unit frame along its longitudinal direction. The charging unit includes a pair of mounting members, a discharging electrode filament, a shield casing, a grid, and a connecting member. The pair of the mounting members is fixedly mounted on both end portions of the unit frame. The discharging electrode filament extends between the mounting members in a tensioned state. The shield casing is supported between the mounting members by being connected with the mounting members, and covers the discharging electrode filament. The grid extends between the mounting members in a tensioned state, and is arranged in an opening in the shield casing at the photoconductive drum side. The pair of the mounting members and the shield casing are connected via the connecting members so as to permit a slight displacement of the mounting members and the shield casing with respect to one another.

According to another preferred embodiment of the present invention, the connecting member includes a catching pin and a catching hole formed on the mounting members and the shield casing. The catching pin and the catching hole are formed such that when the catching pin is inserted in the catching hole, the catching pin is loosely fit in the catching hole. The grid preferably extends in a tensioned state in its longitudinal direction between the mounting members via a spring member.

According to another preferred embodiment of the present invention, the mounting members arranged at both end portions of the charging unit and the shield casing, which define the charging unit, are connected via the connecting member that permits a slight displacement of the mounting members and the shield casing. Therefore, when mounting the mounting members to the unit frame, even when the unit frame is distorted by being twisted in the longitudinal direction, each of the mounting members responds to the distortion. As a result, the mounting members can be reliably mounted and fixed. Moreover, since the grid extends between the mounting members in a tensioned state and is arranged in the opening of the shield casing at the photoconductive drum side, the distance between the grid and the surface of the photoconductive drum is maintained at a prescribed distance along the longitudinal direction. As a result, an uneven charge is not generated. Furthermore, since the discharging electrode filament also extends between the mounting members in a tensioned state, the discharging electrode filament and the grid are maintained under a prescribed relative positional relationship. The reliability of mounting the charging unit on the unit frame, and the response of the grid with respect to the unit frame are accomplished by the mounting members and the shield casing being connected via the connecting member that permits a slight displacement between the mounting members and the shield casing. As a result, just a simple structure is required, and an increase in the number of components and an increase in cost can be prevented.

According to the above-described preferred embodiments of the present invention, the connecting member includes the catching pin and the catching hole formed on the mounting members and the shield. The catching pin and the catching hole are constructed and arranged such that when the catching pin is inserted in the catching hole, the catching pin is loosely fit in the catching hole. As a result, reliability of mounting and the response of the grid with respect to the unit frame can be accomplished extremely easily. According to another preferred embodiment of the present invention, the grid extends in a tensioned state in its longitudinal direction via the spring member with respect to the mounting members. Therefore, the grid is always maintained in a tensioned state. In addition, since the mounting members can be mounted reliably in response to the unit frame, a prescribed distance can be reliably maintained between the grid and the surface of the photoconductive drum.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described with reference to the accompanying drawings.

Figure 1:
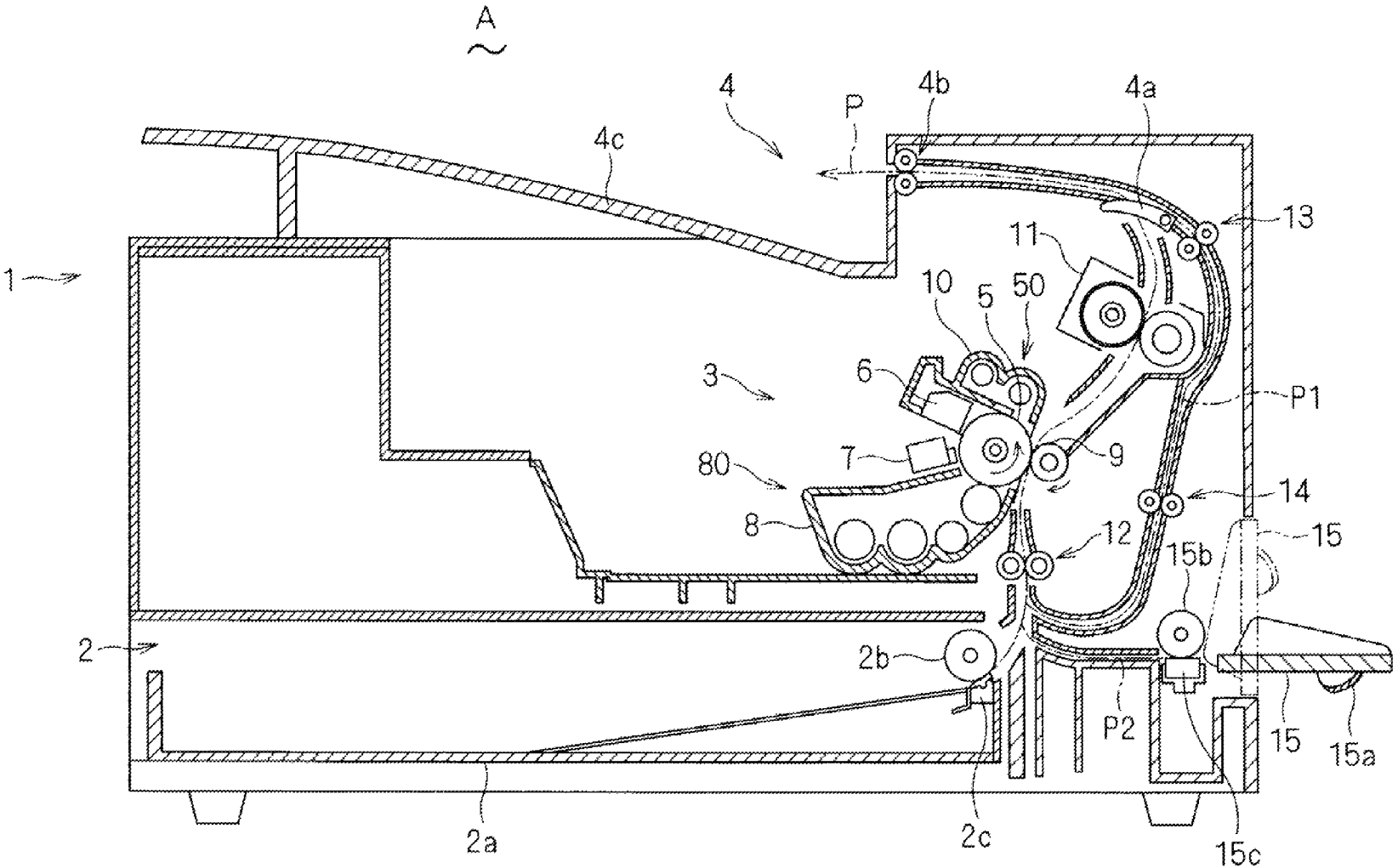
FIG. 1 is a longitudinal cross-sectional view of an example of an image forming device including a photoconductive drum unit according to a preferred embodiment of the present invention.

An image forming device (A) illustrated in FIG. 1 is a printer including an electrophotographic printing unit as an example. The image forming device (A) is not limited to the illustrated example, and may be a copier, a facsimile machine, or an MFP including a copier function and/or a facsimile function including an image scanning device, or any other suitable device. In FIG. 1, a device main body 1 of the image forming device (A) includes a paper feeding unit 2 containing printing papers, an electrophotographic image printing unit 3, and a discharge unit 4 where printed out papers are discharged. The paper feeding unit 2, the image printing unit 3, and the discharge unit 4 are preferably vertically stacked in this order. The paper feeding unit 2 includes a paper feed cassette 2*a*, a paper separating and feeding roller 2*b*, and a separating pad 2*c*. The paper feed cassette 2*a* accommodates a plurality of stacked printing papers, and can be inserted and drawn out with respect to the device main body 1. The separating roller (pickup roller) 2*b* is arranged at a front end portion of the paper feed cassette 2*a*. The separating pad 2*c* elastically makes contact with a peripheral surface of the paper separating and feeding roller 2*b*. The paper feeding unit 2 is not limited to a single cassette system as illustrated in FIG. 1, and may include a plurality of cassettes or use an option cassette system.

The image printing unit 3 includes a process portion and a fusing unit 11 arranged downstream of the process portion. In the process portion, a charging unit 6, an exposing unit 7 such as a Light Emitting Diode (LED), a developing device 8, a transfer roller 9, and a remaining toner removing device 10 are arranged in this order around a photoconductive drum 5. Excluding the exposing unit 7 and the transfer roller 9, the process portion is provided as a process unit including a photoconductive drum unit 50 and a developing device unit 80. Further, the photoconductive drum unit 50 collectively includes the photoconductive drum 5, the charging unit 6, and the remaining toner removing device 10. The developing device unit 80 collectively includes a toner container, an agitator, and a developing roller or the like. The photoconductive drum unit 50 and the developing device unit 80 are preferably removably inserted in the device main body 1 from its front surface side. Further, the photoconductive drum unit 50 and the developing device unit 80 may be inserted separately, or inserted under a state in which the photoconductive drum unit 50 and the developing device unit 80 are connected by a connecting member. Alternatively, the entire process portion excluding the exposing unit 7 and the transfer roller 9 may be collectively provided as a process unit. Further, the front surface side of the device main body 1 refers to the side as viewed in FIG. 1, and a rear surface side refers to the side opposite to the front surface side.

A switching gate 4*a*, a discharge roller pair 4*b*, and a discharge tray 4*c* are arranged downstream of the fusing unit 11. The switching gate 4*a*, the discharge roller pair 4*b*, and the discharge tray 4*c* define the discharge unit 4. A resist roller pair 12 is arranged near an upstream side of the process portion. Printing papers accommodated in the paper feed cassette 2*a* are separated and picked up one sheet at a time by the paper separating and feeding roller 2*b* and the separating pad 2*c*, and resisted by the resist roller pair 12. The printing paper is introduced into a contact portion between the photoconductive drum 5 and the transfer roller 9. The photoconductive drum 5 rotates in a direction of an arrow illustrated in FIG. 1, and the surface of the photoconductive drum 5 is uniformly charged by the charging unit 6. An optical image based on image information is irradiated on the surface of the photoconductive drum 5 by the exposing unit 7. Accordingly, an electrostatic latent image is formed on the surface of the photoconductive drum 5. Further, the electrostatic latent image is formed according to the characteristics of a photoconductor on the surface of the photoconductive drum 5, i.e., an electric potential of the irradiated portion changes while an electric potential of other portions is maintained.

The electrostatic latent image is sequentially developed by the biased developing device 8, and reaches the contact portion between the photoconductive drum 5 and the transfer roller 9 as a toner image. During a developing process, according to a potential difference between the developing device 8 and the surface of the photoconductive drum 5, toner is adhered to the photoconductive drum 5 to form a black portion on a portion of the photoconductive drum 5 where the electric potential has changed by the irradiated light, and toner is not adhered to the remaining portion of the photoconductive drum 5 to form a white portion. Therefore, a black and white image according to image information is formed as a whole. The resist roller pair 12 is controlled to be rotatably driven such that printing paper is introduced into the contact portion between the photoconductive drum 5 and the transfer roller 9 in synchronism with the toner image being formed on the surface of the photoconductive drum 5.

A bias voltage is applied to the transfer roller 9. The transfer roller 9 is in contact with the photoconductive drum 5, and nips and transports printing paper while being rotatably driven in a direction illustrated by an arrow in FIG. 1. At this time, the toner image on the surface of the photoconductive drum 5 is transferred onto the printing paper. The toner remaining on the surface of the photoconductive drum 5 is removed by the remaining toner removing device 10 and collected. The printing paper on which the toner image has been transferred is introduced into the fusing unit 11. After the toner image is fixed as a permanent image, the printing paper pushes up the switching gate 4*a*, and is discharged onto the discharge tray 4*c* via the discharge roller pair 4*b*. The paper feeding process is carried out along a main feeding path P. The main feeding path P rises substantially vertically (perpendicularly) immediately after the paper feed cassette 2*a*, and makes a U-turn before the discharge roller pair 4*b* in a direction substantially 180 degrees opposite from a direction in which printing paper is picked up from the paper feed cassette 2*a*. Such a layout structure minimizes the size of the image forming device (A) as a whole.

The image forming device (A) includes a duplex printing function. A reverse feeding path P1 bypasses and connects the main feeding path P at a position where the switching gate 4*a* is mounted and at a position upstream of the resist roller pair 12. The discharge roller pair 4*b* can rotate in both directions. Transportation roller pairs 13 and 14 are arranged in the reverse feeding path P1. When carrying out a duplex printing operation, after one side of the printing paper is printed as described above, the printing paper is transported along the main feeding path P, and when a trailing edge of the printing paper reaches the discharge roller pair 4*b*, the discharge roller pair 4*b* stops once to temporarily nip the trailing edge of the printing paper. Next, the discharge roller pair 4*b* rotates backward, and the printing paper is transported through the reverse feeding path P1 by the transportation roller pairs 13 and 14 by its trailing edge. The printing paper eventually joins the main feeding path P and reaches the resist roller pair 12. The printing paper is resisted by the resist roller pair 12, and is introduced into the contact portion between the photoconductive drum 5 and the transfer roller 9 again. A printing operation is performed on a reverse side of the printing paper. After both sides of the printing paper are printed, the printing paper is transported along the main feeding path P and discharged onto the discharge tray 4*c* as described above.

The image forming device (A) preferably further includes a manual feeding function. A manual feeding tray 15 is arranged on a side of the device main body 1 in a manner that the manual feeding tray 15 can be opened and closed vertically. When not using the manual feeding tray 15, the manual feeding tray 15 is closed as illustrated by double-dashed lines in FIG. 1. The manual feeding tray 15 can be opened and closed by a gripper 15*a*. A paper separating and feeding roller 15*b* and a separating pad 15*c* are arranged to contact against one another at a front end portion of the manual feeding tray 15. A manual feeding path P2 is arranged downstream of such a contact portion, and joins with the main feeding path P.

When carrying out an image printing operation using the manual feeding tray 15, the gripper 15*a* is operated to open the manual feeding tray 15. Printing papers are set on the manual feeding tray 15, and after a start operation is performed, the manual feeding roller 15*b* starts operating. The printing papers stacked on the manual feeding tray 15 are separated and picked up one sheet at a time by the paper separating and feeding roller 15*b* and the separating pad 15*c*. The printing paper is transported along the manual feeding path P2, and joins the main feeding path P. Then, the printing paper is resisted by the resist roller pair 12, and introduced into the contact portion between the photoconductive drum 5 and the transfer roller 9 where a printing operation is performed. When carrying out a duplex printing operation on the manually fed paper, the discharge roller pair 4*b* rotates backward to transport the printing paper to the reverse feeding path P1, and the printing operation is performed on the reverse side of the printing paper as described above. After the printing operation is completed, the printing paper is discharged onto the discharge tray 4*c* by the discharge roller pair 4*b*.

Next, with reference to FIG. 2 and FIG. 3, a detailed description will be made of the photoconductive drum unit 50. The photoconductive drum 5 preferably includes an aluminum conductive cylindrical body. A photoconductor is coated on the surface of the cylindrical body. Flange members 5*a* and 5*b* are fixed on an opening at both ends of the cylindrical body. Further, the flange members 5*a* and 5*b* are preferably made of an insulating resin or plastic. The flange members 5*a* and 5*b* are supported at both ends on a unit frame 51 via bearings 51*a* and 51*b*, respectively. Further, the unit frame 51 is preferably made of resin or plastic. The photoconductive drum 5 is supported rotatably on the unit frame 51 by the bearings 51*a* and 51*b* via the flange members 5*a* and 5*b*. The flange members 5*a* and 5*b* are respectively supported rotatably on drum shafts 1*a* and 1*b* fixed on a frame of the device main body 1. The drum shafts 1*a* and 1*b* also function as a positioning pin. Gears 5*c* and 5*d* are respectively arranged concentrically on the surface of the flange members 5*a* and 5*b*. The gear 5*c* is engaged with a drive transmitting system (not illustrated) in the device main body 1. The photoconductive drum 5 rotates with the drum shafts 1*a* and 1*b* as a rotational axis by a driving force from the transmitting system. The gear 5*d* at an opposite side engages with a driven force transmitting gear of a mechanism portion (not illustrated) of the transfer roller 9 or the like. Accordingly, a rotational driving force is transmitted to the mechanism portion.

The charging unit 6 is preferably a scorotron charging unit. The charging unit 6 preferably includes a pair of mounting members 61 and 62, a discharging electrode filament 63, a shield casing 64, and a grid 65. The mounting members 61 and 62, the discharging electrode filament 63, the shield casing 64, and the grid 65 are unitized in a single unit to define the charging unit 6. The pair of the mounting members 61 and 62 are mounted and fixed on both end portions of the unit frame 51. The discharging electrode filament 63 extends between the mounting members 61 and 62 in a tensioned state. The shield casing 64 is preferably substantially U-shaped in its cross-section. The shield casing 64 is supported between the mounting members 61 and 62, and connected with the mounting members 61 and 62. The shield casing 64 covers the discharging electrode filament 63. The grid 65 extends between the mounting members 61 and 62 in a tensioned state, and is arranged in an opening 64*a* of the shield casing 64 at the photoconductive drum 5 side. The mounting members 61 and 62 are respectively fixed on the unit frame 51 by tightening screws 61*b* and 62*b* in screw holes 61*a* and 62*a* respectively formed on the mounting members 61 and 62.

Figure 2:
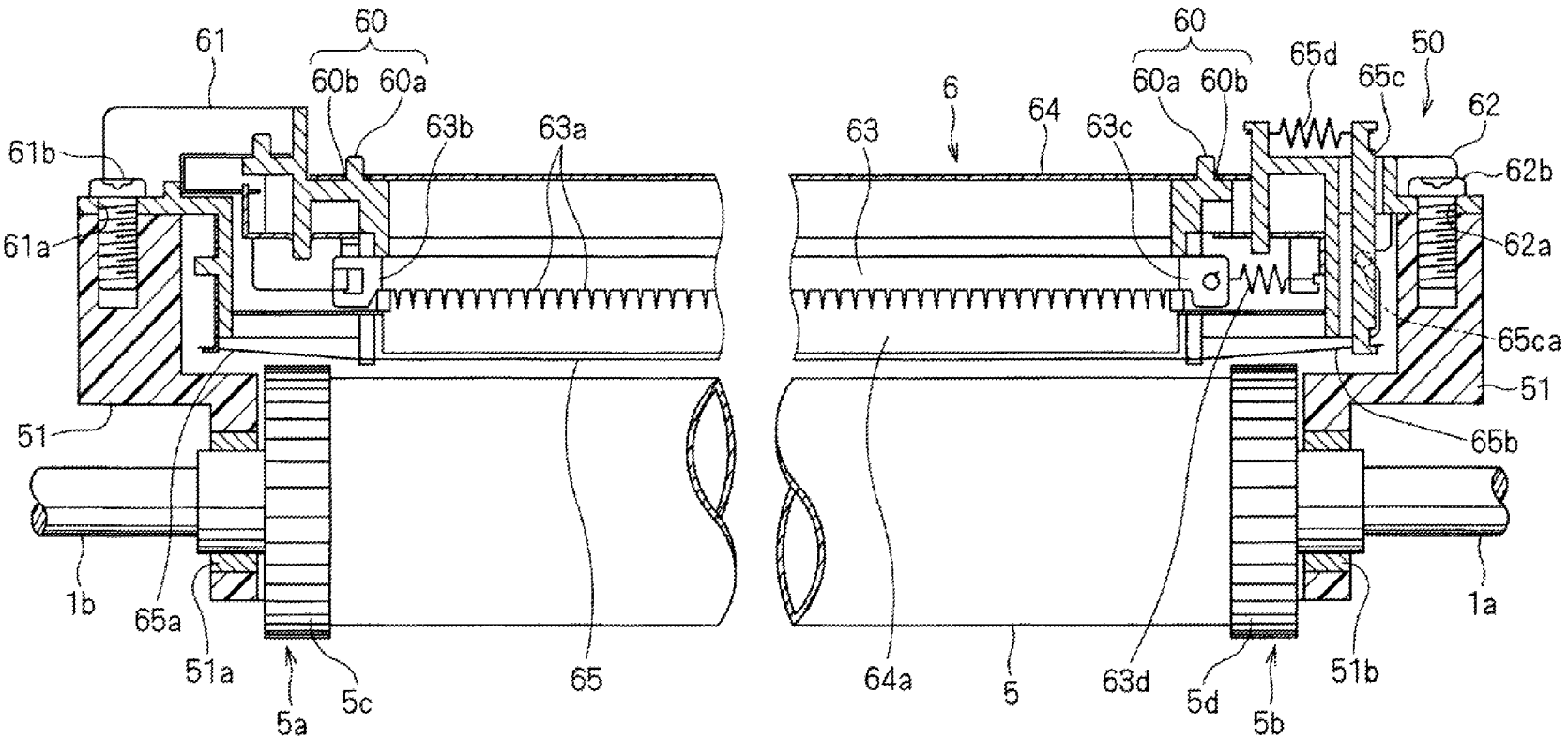
FIG. 2 is a cross-sectional view of the photoconductive drum unit.
Figure 3:
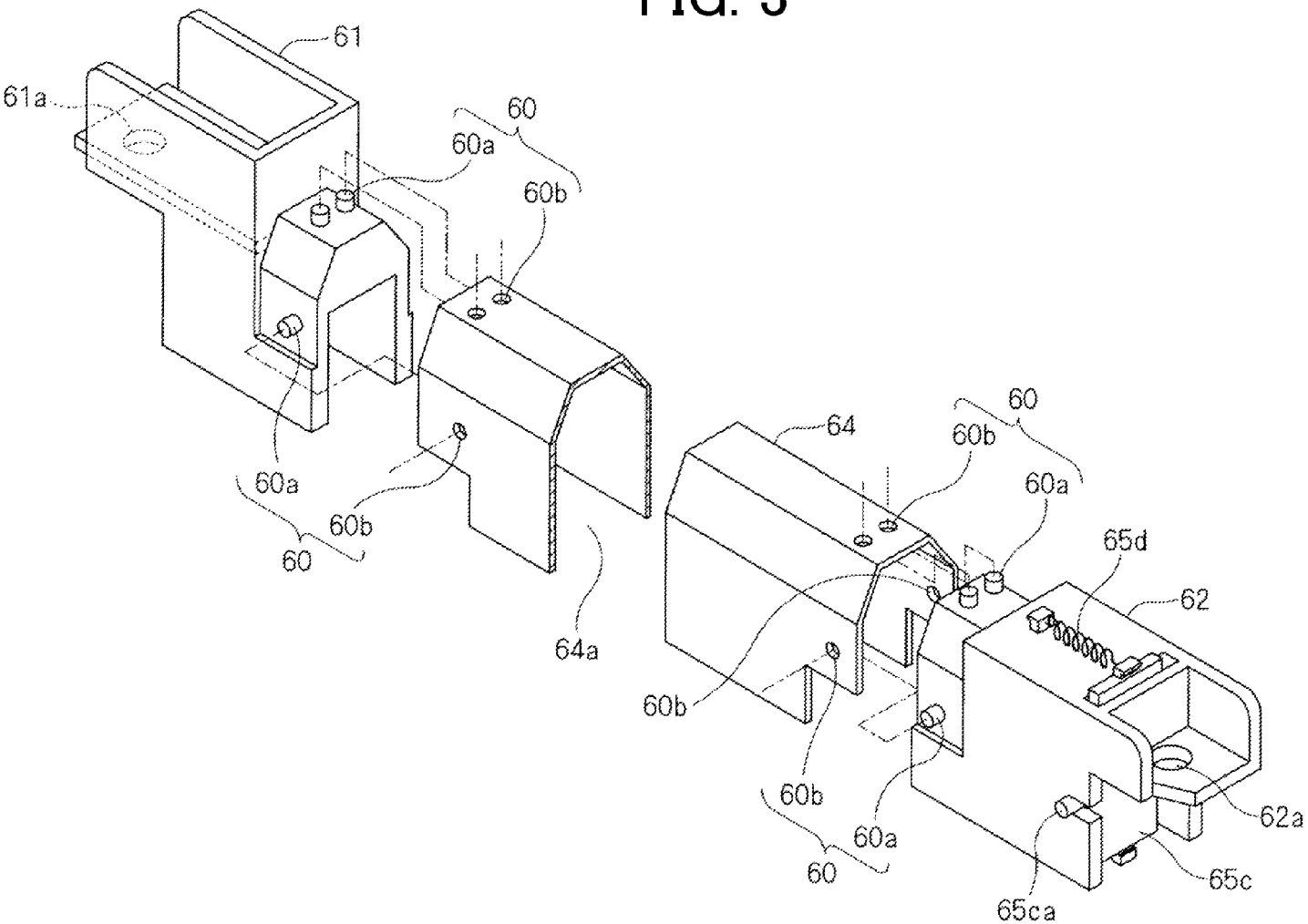
FIG. 3 is a partial exploded perspective view illustrating a relationship of mounting members and a shield casing in a charging unit arranged in the photoconductive drum unit.

The discharging electrode filament 63 is a corona discharge electrode, and is formed of a thin band-like metal plate having a plurality of needle-like electrodes 63*a* as illustrated in FIG. 2. The discharging electrode filament 63 may be a metal wire. One end portion 63*b* of the discharging electrode filament 63 is attached to the mounting member 61. Another end portion 63*c* is attached to the other mounting member 62 via a tension spring 63*d*. As described above, the discharging electrode filament 63 extends between the mounting members 61 and 62 in a tensioned state. The grid 65 is preferably a thin metal plate on which a plurality of slits are formed. One end 65*a* of the grid 65 is attached to the mounting member 61. Another end 65*b* is attached to the mounting member 62 via a swinging portion 65*c* and a tension spring (spring member) 65*d*.

The swinging portion 65*c* is arranged to penetrate through the mounting member 62 from the photoconductive drum 5 side to its opposite side. At the same time, the swinging portion 65*c* is supported so as to be capable of swinging around a supporting pin 65*ca*. The other end 65*b* of the grid 65 is attached to a protruding end portion of the swinging portion 65*c* at the photoconductive drum 5 side. The tension spring 65*d* is attached to another protruding end portion of the swinging portion 65*c* at the opposite side. The shield casing 64 having a substantially U-shape in its cross-section is arranged such that its opening 64*a* faces towards the photoconductive drum 5 side. The grid 65 is located in the opening 64*a* of the shield casing 64. The grid 65 is tensioned by a pulling force of the tension spring 65*d* via the swinging portion 65*c*, and extends between the mounting members 61 and 62 in a tensioned state. When the photoconductive drum unit 50 is inserted in a prescribed portion in the image forming device (A), the discharging electrode filament 63 and the grid 65 make contact with a power electrode (not illustrated) in the device main body 1. A prescribed voltage can be applied to each of the discharging electrode filament 63 and the grid 65.

The mounting members 61 and 62 and the shield casing 64 are connected via connecting members 60. A further description will be made with reference to FIG. 3. FIG. 3 is an exploded perspective view illustrating a relationship of how the mounting members 61 and 62 are connected with the shield casing 64. Further, the discharging electrode filament 63 and the grid 65 are not illustrated in FIG. 3. A plurality of catching pins 60*a* protrude from side surfaces of the mounting members 61 and 62 and from a surface of the mounting members 61 and 62 located opposite from the photoconductive drum 5 side. Meanwhile, a plurality of catching holes 60*b* are formed on the shield casing 64 at positions corresponding to the catching pins 60*a*. Further, a diameter of the catching holes 60*b* is slightly larger than a diameter of the catching pins 60*a*, or the catching holes 60*b* are oval. The connecting members 60 are formed by the catching pins 60*a* being inserted in the catching holes 60*b*. The catching pins 60*a* and the catching holes 60*b* are formed such that when the catching pins 60*a* are inserted in the catching holes 60*b*, the catching pins 60*a* loosely fit in the catching holes 60*b*.

The mounting members 61 and 62 and the shield casing 64 are connected by inserting and catching the catching pins 60*a* in the catching holes 60*b*. Since the catching holes 60*a* have a larger diameter than the catching pins 60*b* or are oval, the catching pins 60*a* are loosely inserted in the catching holes 60*b*. As a result, the mounting members 61 and 62 and the shield casing 64 connected by the connecting members 60 permit a slight displacement. Under such a connected state of the mounting members 61 and 62 and the shield casing 64, as described above, the discharging electrode filament 63 and the grid 65 respectively extend between the mounting members 61 and 62 in a tensioned state by being tensioned by the tension springs 63*d* and 65*d*, respectively.

Since the mounting members 61 and 62 are fixed on the unit frame 51 by tightening the screws 61*b* and 62*b*, when assembling the charging unit 6 in the photoconductive drum unit 50, for example, even if the unit frame 51 is distorted, a restriction of the shield casing 64 is small and the mounting members 61 and 62 can adjust to the unit frame 51. Therefore, the mounting members 61 and 62 can be fixed reliably. Since the discharging electrode filament 63 and the grid 65 extend between the mounting members 61 and 62 in a tensioned state, an initial relative positional relationship of the discharging electrode filament 63 and the grid 65 does not change. Furthermore, a relative distance between the grid 65 and the surface of the photoconductive drum 5 in its longitudinal direction is maintained substantially constant. In addition, since the discharging electrode filament 63 and the grid 65 extend in a tensioned state by the tension springs 63*d* and 65*d*, the mounting members 61 and 62 respond to the distortion of the unit frame 51. As a result, even when the grid 65 is relatively displaced with respect to the shield casing 64, the grid 65 is always maintained under a tensioned state, and the relative distance between the grid 65 and the surface of the photoconductive drum 5 can be reliably kept constant.

As described above, the distortion or the like of the unit frame 51 can be compensated for by a simple structure, i.e., the connecting members 60 including the catching holes 60*b* and the catching pins 60*a*, and the grid 65, which is provided under a tensioned state. In addition, a constant distance can be maintained between the grid 65 and the surface of the photoconductive drum 5. As a result, uneven charging can be prevented in the longitudinal direction of the photoconductive drum 5, and deterioration in an image quality can be prevented.

Further, the shape of the shield casing 64 of the charging unit 6 and the overall shape of the mounting members 61 and 62 are not limited to the illustrated examples. For example, a resin or plastic film may be adhered like a skirt on a side portion of the shield casing. The shape of the catching pins 60*a* and the catching holes 60*b* of the connecting member 60 is also not limited to a cylindrical pin or a circular hole as illustrated in the drawings. For example, the catching pins 60*a* and the catching holes 60*b* may be a prism pin and a rectangular hole, or formed in any other suitable shape. Additionally, the catching pins 60*a* may be formed on the shield casing 64, and the catching holes 60*b* may be formed on the mounting members 61 and 62.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. A charging device mounted on a frame, the charging device comprising:

a pair of mounting members mounted and fixed on both end portions of the frame;

a discharging electrode filament extending between the mounting members in a tensioned state;

a shield casing arranged to cover the discharging electrode filament by being supported between the mounting members and connected with the mounting members;

a grid extending between the mounting members in a tensioned state and arranged in an opening of the shield casing;

at least one connecting member arranged to connect the pair of the mounting members and the shield casing in a state in which a slight displacement between the mounting members and the shield casing is permitted; and a plate-shaped swinging member arranged to connect the grid to at least one of the mounting members in the tensioned state and to swing about a pin.

2. The charging device according to claim 1, wherein the at least one connecting member includes a catching pin and a catching hole arranged on the mounting members and the shield casing to loosely connect with one another.

3. The charging device according to claim 2, further comprising a spring tensioning the grid in its longitudinal direction with respect to the mounting members through the swinging portion.

4. The charging device according to claim 2, wherein the discharging electrode filament is a thin band-shaped metal plate including a plurality of electrodes.

5. The charging device according to claim 2, wherein the pair of the mounting members, the discharging electrode filament, the shield casing, and the grid are unitized so as to define a single unitary structural element.

6. The charging device according to claim 2, wherein a diameter of the catching hole is slightly larger than a diameter of the catching pin.

7. The charging device according to claim 2, wherein the catching hole is oval.

8. A photoconductive drum unit comprising:

a frame;

a photoconductive drum rotatably supported on the frame; and a charging unit arranged to face a surface of the photoconductive drum, and mounted and fixed at both end portions of the frame to be arranged along a longitudinal direction of the photoconductive drum; wherein the charging unit includes:

a pair of mounting members mounted and fixed on the end portions of the frame;

a discharging electrode filament extending between the mounting members in a tensioned state;

a shield casing arranged to cover the discharging electrode filament by being supported between the mounting members and connected with the mounting members;

a grid extending between the mounting members in a tensioned state and arranged in an opening of the shield casing;

at least one connecting member arranged to connect the pair of the mounting members and the shield casing in a state in which a slight displacement between the mounting members and the shield casing is permitted; and a plate-shaped swinging member arranged to connect the grid to at least one of the mounting members in the tensioned state and to swing about a pin.

9. The photoconductive drum unit according to claim 8, wherein the at least one connecting member includes a catching pin and a catching hole arranged on the mounting members and the shield casing to loosely connect with one another.

10. The photoconductive drum unit according to claim 9, further comprising a spring which tensions the grid in its longitudinal direction with respect to the mounting members through the swinging portion.

11. The photoconductive drum unit according to claim 9, wherein the discharging electrode filament is a thin band-shaped metal plate including a plurality of needle-like electrodes.

12. The photoconductive drum unit according to claim 9, wherein the pair of the mounting members, the discharging electrode filament, the shield casing, and the grid are unitized so as to define a single unitary structural element.

13. The photoconductive drum unit according to claim 9, wherein a diameter of the catching hole is slightly larger than a diameter of the catching pin.

14. The photoconductive drum unit according to claim 9, wherein the catching hole is oval.

15. An image forming device comprising:

a photoconductive drum unit including a photoconductive drum and a charging unit; and a developing device unit which includes a toner container and a developing roller; wherein the photoconductive drum unit includes:

a frame;

the photoconductive drum rotatably supported on the frame; and a charging unit arranged to face a surface of the photoconductive drum, and mounted and fixed at both end portions of the frame to be arranged along a longitudinal direction of the photoconductive drum; wherein the charging unit includes:

a pair of mounting members mounted and fixed on the end portions of the frame;

a discharging electrode filament extending between the mounting members in a tensioned state;

a shield casing arranged to cover the discharging electrode filament by being supported between the mounting members and connected with the mounting members;

a grid extending between the mounting members in a tensioned state and arranged in an opening of the shield casing;

at least one connecting member arranged to connect the pair of the mounting members and the shield casing in a state in which a slight displacement between the mounting members and the shield casing is permitted; and a plate-shaped swinging member arranged to connect the grid to at least one of the mounting members in the tensioned state and to swing about a pin.

16. The image forming device according to claim 15, wherein the connecting member includes a catching pin and a catching hole arranged on the mounting members and the shield casing to loosely connect with one another.

17. The image forming device according to claim 16, further comprising a spring which tensions the grid in its longitudinal direction with respect to the mounting members through the swinging portion.

18. The image forming device according to claim 16, wherein the discharging electrode filament is a thin band-shaped metal plate including a plurality of needle-like electrodes.

19. The image forming device according to claim 16, wherein the pair of the mounting members, the discharging electrode filament, the shield casing, and the grid are unitized so as to define a single unitary structural element.

20. The image forming device according to claim 16, wherein a diameter of the catching hole is slightly larger than a diameter of the catching pin.

21. The image forming device according to claim 16, wherein the catching hole is oval.

* * * * *